US011027207B2

(12) United States Patent
Walser et al.

(10) Patent No.: US 11,027,207 B2
(45) Date of Patent: Jun. 8, 2021

(54) AMUSEMENT RIDE WITH GONDOLAS MOUNTED ON A SUPPORT AND HAVING ROWS OF SEATS MOUNTED BY CARDAN SUSPENSION

(71) Applicants: Willy Walser, Murg (CH); Roman Rothe, Schübelbach (CH)

(72) Inventors: Willy Walser, Murg (CH); Roman Rothe, Schübelbach (CH)

( * ) Notice: Subject to any disclaimer, the term of this patent is extended or adjusted under 35 U.S.C. 154(b) by 21 days.

(21) Appl. No.: 16/604,509

(22) PCT Filed: Mar. 29, 2018

(86) PCT No.: PCT/EP2018/058165

§ 371 (c)(1),
(2) Date: Oct. 10, 2019

(87) PCT Pub. No.: WO2018/188970

PCT Pub. Date: Oct. 18, 2018

(65) Prior Publication Data

US 2020/0147504 A1 May 14, 2020

(30) Foreign Application Priority Data

Apr. 10, 2017 (EP) ..... 17165809

(51) Int. Cl.
*A63G 27/02* (2006.01)
*A63G 27/04* (2006.01)

(52) U.S. Cl.
CPC ..... *A63G 27/02* (2013.01); *A63G 27/04* (2013.01)

(58) Field of Classification Search
CPC ..... A63G 27/02; A63G 27/04; A63G 31/08; A63G 31/00; A63G 27/00; A63G 27/06; A63G 31/14; A63G 9/16; A63G 1/00
See application file for complete search history.

(56) References Cited

U.S. PATENT DOCUMENTS 2,280,643 A * 4/1942 Courtney ..... A63G 1/26 472/1
2,294,166 A * 8/1942 Eyerly ..... A63G 27/02 472/1

(Continued)

FOREIGN PATENT DOCUMENTS

EP 1055437 11/2000
LU LU39215 11/1960

*Primary Examiner* — Michael D Dennis
(74) *Attorney, Agent, or Firm* — Thomas M. Freiburger

(57) ABSTRACT

The invention relates to an amusement ride having a base (1) to which is fastened at least one pivotable or rotatable support (2) for holding rows of seats (4) mounted in gondolas (3, 8) on the support, the gondolas (3, 8) being movable on the support (2) at least in the vertical direction in relation to the base, and the rows of seats (4) being rotatable or pivotable in the gondolas (3, 8) in at least two planes which are perpendicular to each other. According to the invention, the support (2) contains at least two gondolas (3, 8) which are formed by frames (5, 6, 7) which interlock in a Cardan suspension, as a result of which the rows of seats (4) are mounted by Cardan suspension in the gondolas (3, 8) and are movable in three planes which are perpendicular to one another. While one of the gondolas (8) can be loaded and unloaded in its starting position, other gondolas (3) fastened to the support can be operated in a predefined movement program.

12 Claims, 14 Drawing Sheets

(56) References Cited

U.S. PATENT DOCUMENTS

| | | | | | |
|---|---|---|---|---|---|
| 3,072,399 | A * | 1/1963 | Simpkins | A63G 27/00 | 472/30 |
| 3,243,184 | A * | 3/1966 | Glen Robinson | A63G 27/04 | 472/1 |
| 3,707,282 | A * | 12/1972 | Robinson | A63G 27/04 | 472/1 |
| 3,905,596 | A * | 9/1975 | Barber | A63G 1/28 | 472/3 |
| 5,791,998 | A * | 8/1998 | Moser | A63G 27/04 | 472/31 |
| 6,620,051 | B2 * | 9/2003 | Kroon | A63G 27/04 | 472/3 |
| 7,762,895 | B2 * | 7/2010 | Zamperla | A63G 7/00 | 472/43 |
| 9,199,178 | B2 * | 12/2015 | Knijpstra | A63G 27/04 | |
| 2006/0035715 | A1 * | 2/2006 | Threlkel | A63G 27/04 | 472/47 |

* cited by examiner

AMUSEMENT RIDE WITH GONDOLAS MOUNTED ON A SUPPORT AND HAVING ROWS OF SEATS MOUNTED BY CARDAN SUSPENSION

CROSS REFERENCE TO RELATED APPLICATIONS

This application claims priority from international application number PCT/EP2018/058165, filed Mar. 29, 2018, which claimed priority from European application number EP17165809.9, filed Apr. 10, 2017.

BACKGROUND OF THE INVENTION

The invention relates to an amusement ride having a base to which is fastened at least one pivotable or rotatable support for holding rows of seats mounted in gondolas on the support, according to the preamble of claim 1.

In a variety of amusement rides for use at fairs and the like, passengers are taken for a ride in gondolas which are moved with the amusement ride at a certain speed in the vertical direction. The movement can be linear or circular. A circular movement is used in particular on Ferris wheels, in which a plurality of gondolas is fastened to a rotating wheel. The gondolas of the Ferris wheel are pivotally mounted on the periphery of the wheel. In some Ferris wheels, they can also be rotated in a horizontal plane. When the Ferris wheel stops, one or more gondolas located on the platform at the bottom can be loaded and unloaded.

In other swinging amusement rides, seats are located at both ends of a support beam, which can be moved by the movement of the passengers themselves, and/or moved by a motor. The loading and unloading in this version are carried out in a state in which a gondola is situated in the lower area on a platform. The beam must be mechanically fixed when the gondola is unloaded in an unbalanced state, so as to secure the beam.

The process of mounting seats in gondolas by Cardan suspension, so as to provide for movement in three planes, is also known. Such gondolas are lifted by means of a hoisting mast to a greater height after they are loaded, and can then perform the desired movement patterns, either by manual operation or by means of a motor drive. The disadvantage of such an arrangement is that the amusement operation of the ride is interrupted during the raising and lowering of the gondolas and during the loading and unloading.

The invention is therefore based on the object of further developing an amusement ride with gondolas mounted by Cardan suspension, in such a way that at least two corresponding gondolas can be operated at the same time and can be alternately loaded and unloaded, wherein the energy required to operate the amusement ride is minimized and the operation time of the amusement ride per unit of time can be increased.

SUMMARY OF THE INVENTION

This object is achieved by the invention defined in claim 1. Advantageous developments of the invention are specified in the dependent claims.

The invention proceeds from an amusement ride having a base to which is fastened at least one pivotable or rotatable support for holding rows of seats mounted in gondolas, wherein the gondolas are movable on the support with respect to the base, at least in the vertical direction, and the rows of seats in the gondola are rotatable or pivotable in in at least two planes which are perpendicular to each other.

According to the invention, the support comprises at least two gondolas which are formed by frames which interlock in a Cardan suspension, such that the rows of seats in the gondola are movable in three mutually perpendicular planes.

While one of the gondolas can be loaded and unloaded in its starting position, other gondolas fastened to the support can continue to be operated in a program.

Such an amusement ride has the advantage that the special design of the gondolas in the form of a Cardan suspension of the seats can achieve a great amusement effect, and, on the other hand, the operator of the amusement ride can achieve a high passenger turnover rate. The energy required to operate the amusement ride is relatively low. Likewise, the space required for the amusement ride is relatively small.

The support of the amusement ride is preferably an angled or arcuate support beam curved with respect to the base, which is mounted on the base in the central region thereof and carries one gondola on each of its upwardly swept ends. In this ride designed in the manner of a seesaw swing, the support has one gondola at each end. The support is fastened to the base via a pivot joint. If the support is mounted at a high position with respect to the base, relatively high heights can be achieved at the ends upon the movement of the support. The movement control of the gondolas and/or rows of seats arranged in the gondolas is preferably motorized. The up and down movements of the ends of the support are also motorized—for example, by electric motor, hydraulically, or pneumatically. The movements of the support and the gondolas can be adapted to each other with regard to the speed of movement and the movement patterns.

In an alternative embodiment, instead of a pivoting movement about a pivot axis, the support can also be displaced along an arcuate guideway between the support and the base, such that the ends of the support can reach great heights in this way as well.

In another embodiment of the invention, the support is designed as a carrying wheel which is rotatably mounted about a central axis of rotation connected to the base, wherein the carrying wheel includes at least two gondolas on the periphery thereof. The rows of seats in the gondolas are also mounted by Cardan suspension. Although the basic principle corresponds to that of a Ferris wheel, introducing a Cardan suspension of the individual gondolas and/or the rows of seats of the gondolas achieves an elevated amusement effect. The selected number of gondolas can also be greater than two.

In another embodiment, two parallel supports can be used, each having one gondola at each end thereof, such that only one of the gondolas needs to be lowered for loading and unloading during the operation of the amusement ride, while the support which does not need to be loaded can continue to operate and the gondola opposite the gondola needing to be loaded or unloaded can remain at a great height.

With the same basic design, each of the two supports can have only one gondola at one end thereof, while the opposite end of the support is equipped with a counterweight, such that, rather than a second gondola on one support, weight can be balanced in this manner during continuing operation.

The frames of the gondolas which are interconnected in a Cardan suspension are preferably rectangular, oval or circular. In this design, an outer frame is rotatably mounted on the two arms of each support, while the rows of seats are fastened to an inner frame. An intermediate frame interlocks the outer and inner frames with each other in a Cardan suspension. Preferably, the rows of seats are fastened to both ends of a leg of the inner frame. The rows of seats can also be fastened to two opposite legs of the inner frame to establish better symmetry of weight. In this embodiment, however, suitable arrangements for loading and unloading the seats must be provided on the platform. These are easier to produce when only one leg is loaded or unloaded and the inner frame is vertical.

The rows of seats arranged on the leg or legs of the inner frame can also be rotatable or pivotable.

DESCRIPTION OF THE DRAWINGS

The invention will be explained in more detail below with reference to several embodiments, wherein:

FIGS. 1-3 show an embodiment of the invention in which an arcuate support 2 is held by its central region in a bearing 9 on a platform-like base 1. The base 1 contains a loading and unloading area 10 in which the passengers can enter or exit the gondola 8 arranged at the end of the support 2. A further gondola 3 is arranged on the opposite end of the support 2. This can be entered or exited accordingly in a further loading and unloading area on the base 1. Although the support 2 is shown with an arcuate shape, it may also be obtuse or even rectilinear. An arcuate or angled shape is preferred to obtain great heights at one end when the opposite end is lowered.

Figure 1:
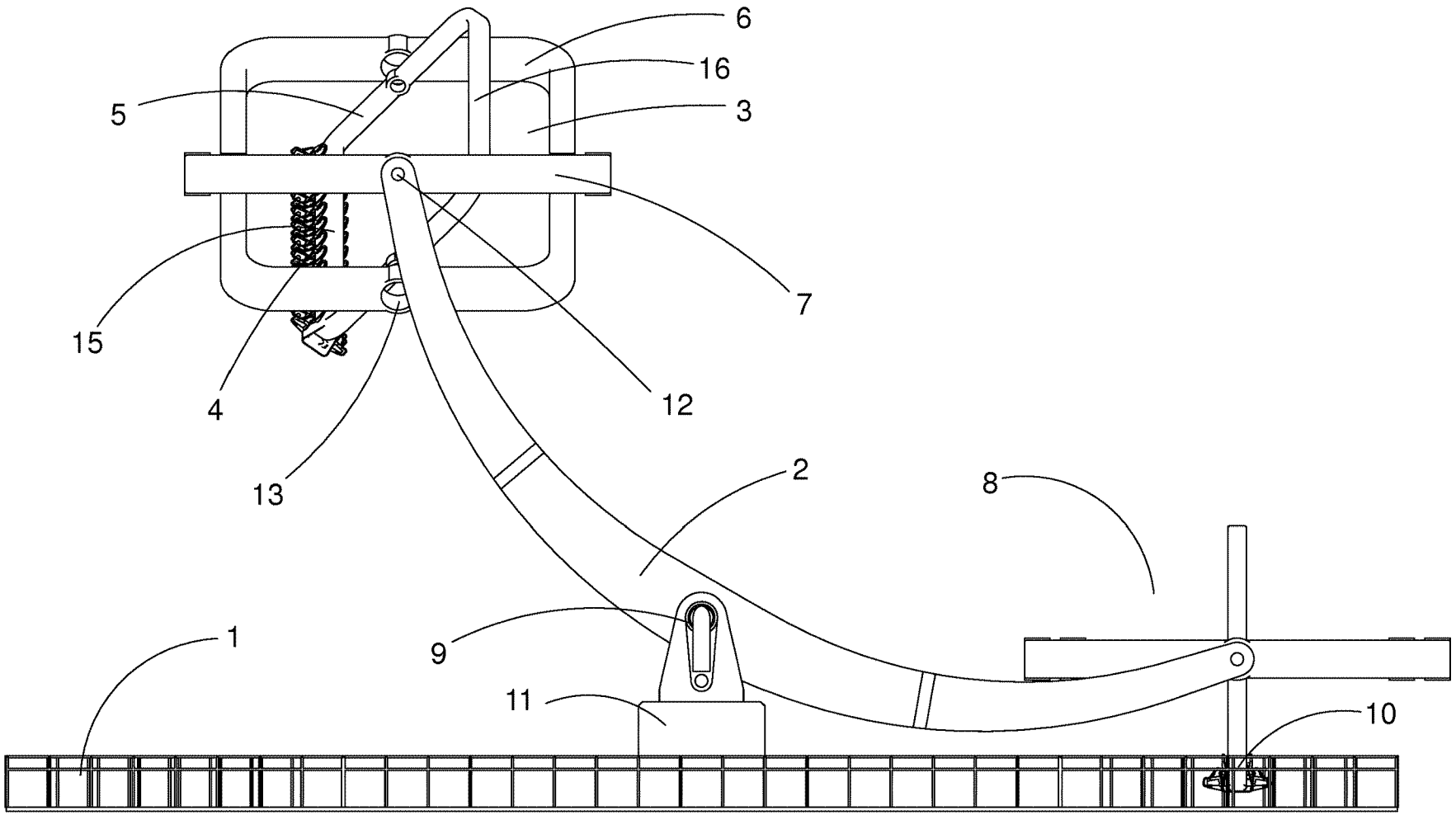
FIGS. 1-3 show an amusement ride with an arcuate support.

The bearing 9 is located on the base 1 on a raised frame 11, such that the ends of the arcuate support 2 can each be pivoted sufficiently far down to enable entering or exiting the gondolas 3 or 8.

The gondolas 3 and 8 are arranged on the support 2 on the ends thereof, and consist of three nested frames, which are mounted perpendicularly to each other. The outer frame 7 is mounted in a bearing 12. The intermediate frame 6 is mounted with its bearing axis perpendicular to the bearing axis 12 in the outer frame 7. Inside the intermediate frame 6, the inner frame 5 is mounted via the bearing 13 with respect to the intermediate frame 6. The arrangement of the bearings 12, 13, 14 of the interlocked frames 5, 6, 7 results in a cardanic mount, such that the inner frame 5 is movable in mutually perpendicular planes. The movement is preferably motorized according to a preselected control program.

The inner frame 5 has, on the free leg 15, two parallel rows of seats 4, wherein the individual seats of the rows of seats are fastened to both sides of the leg. The opposite leg 16 of the inner frame 5 may have a counterweight. However, the leg 16 can also accommodate rows of seats if the loading and unloading of the rows of seats on the platform can be suitably ensured. For this purpose, the legs 15 and 16 should be rotatable relative to the inner frame 5, so that each of the rows of seats can be kept in an upright position during loading and unloading.

The gondolas formed by the frames 5, 6, 7 are preferably rectangular in shape, but they can also be any other shape—such as oval or circular.

For loading and unloading a gondola, the support 2 is lowered at one end far enough that the leg of the inner frame which carries the rows of seats can be lowered to the base 1. After the rows of seats are loaded, the corresponding end of the support 2 can be raised again while the opposite end of the support is lowered. The gondolas can thereby be moved up and down synchronously in the manner of a seesaw swing.

Figure 2:
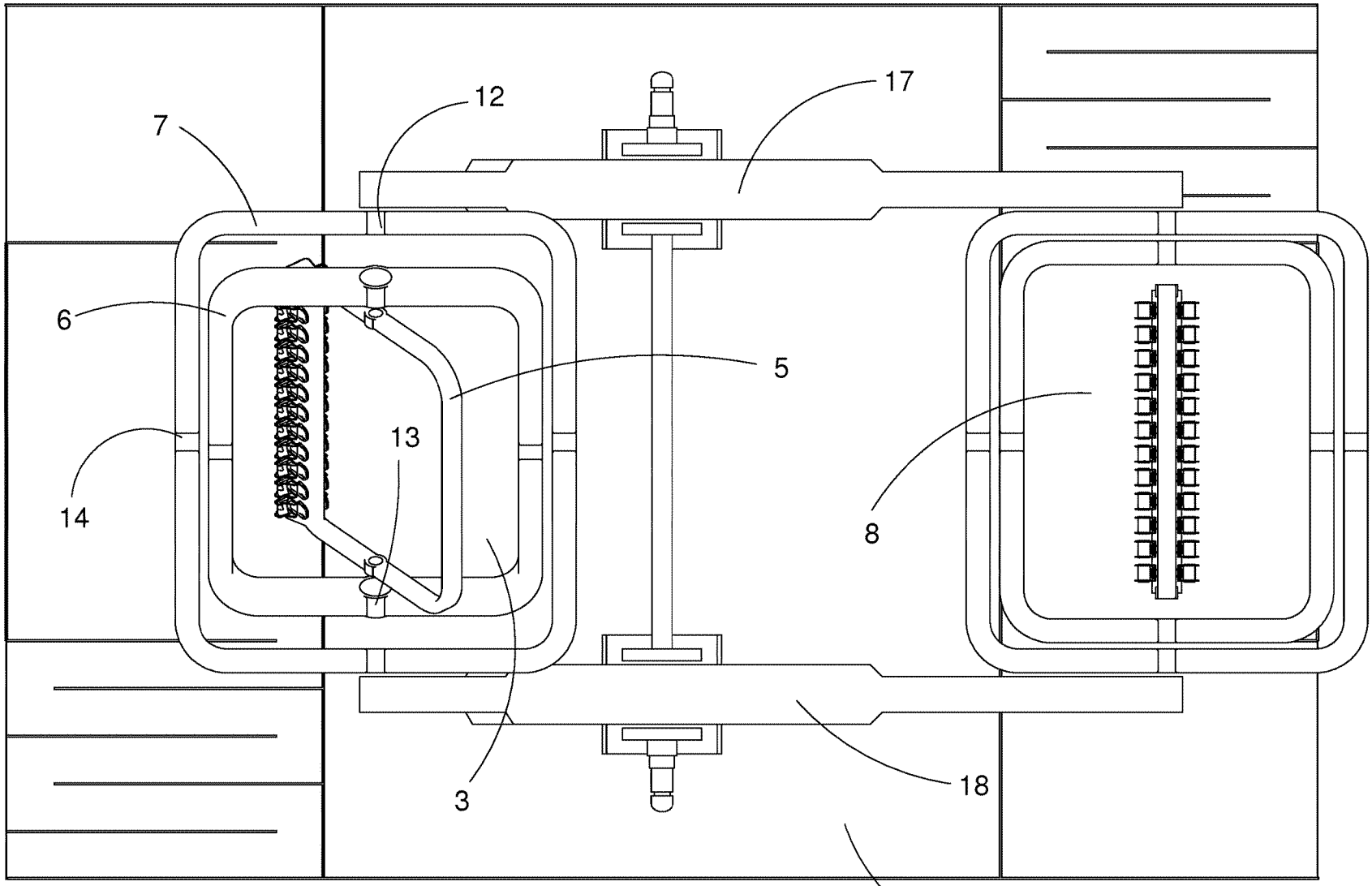

FIG. 2 shows the amusement ride of FIG. 1 in a plan view. The figure shows that the support 2 is formed by two parallel arms 17 and 18, with the outer frames 7 of the two gondolas 3 and 8 accommodated between them. The outer frames 7 are rotatable in a vertical plane about the bearing 12. The intermediate frame 6 is rotatably supported on the outer frame 7 via the bearing 14. The inner frame 5 is mounted in the intermediate frame 6 via the bearing 13.

Figure 3:
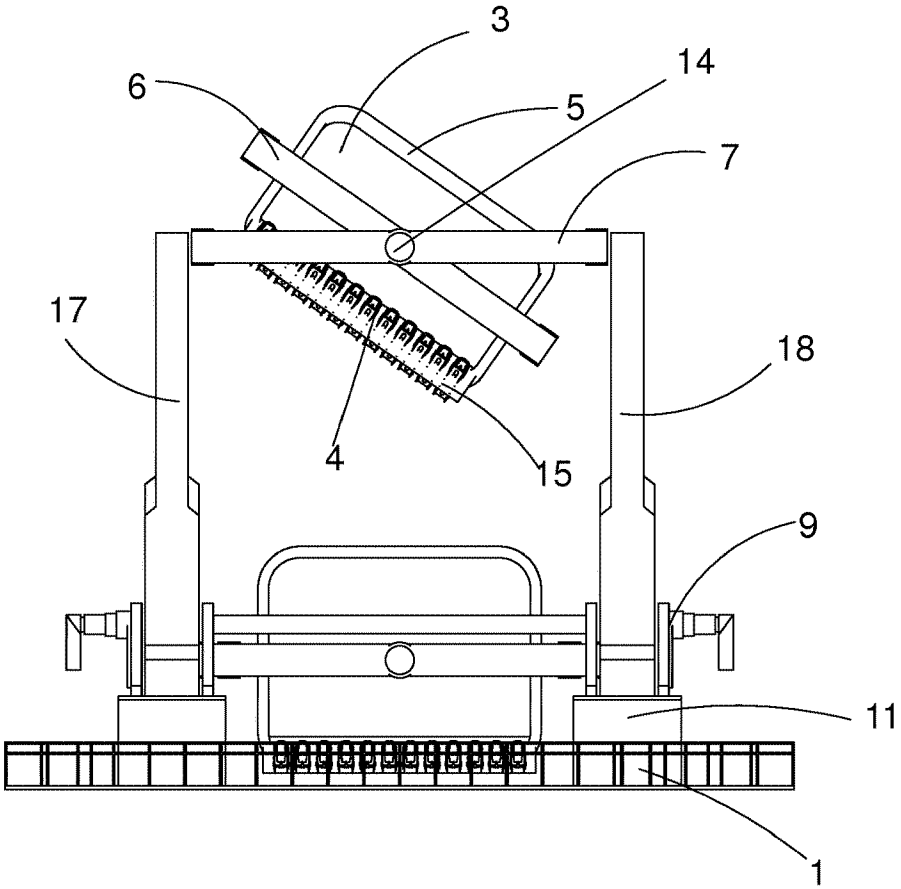

FIG. 3 shows the arrangement in FIG. 1 in front view, with the arms 17 and 18 and a raised gondola 3, as well as a lowered gondola 8. The gondola 3 is in its highest position, while the gondola 8 on the other side of the amusement ride is in the loading and unloading position.

Figure 5:
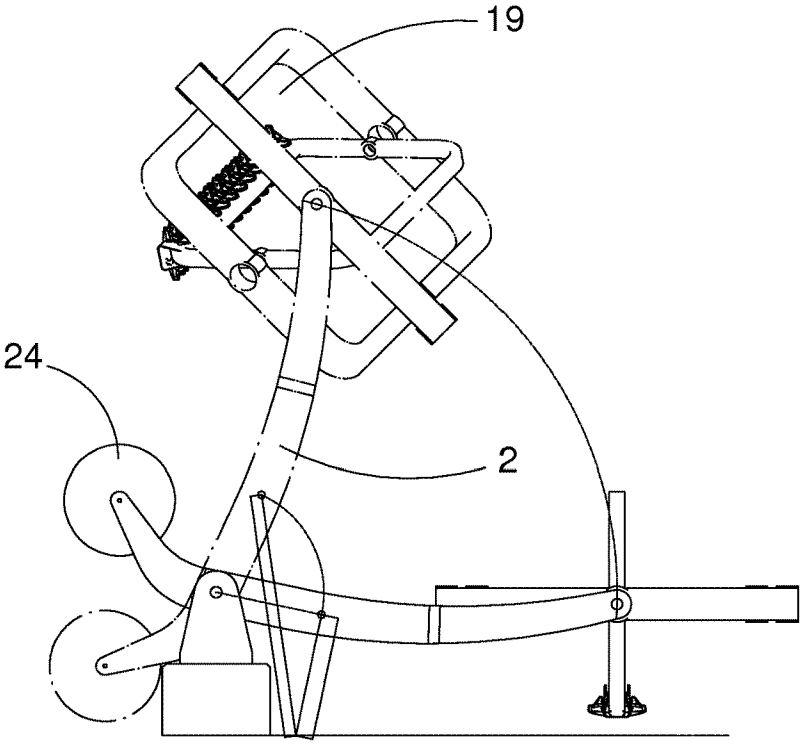
FIGS. 4-6 show an amusement ride with two parallel supports.
Figure 4:
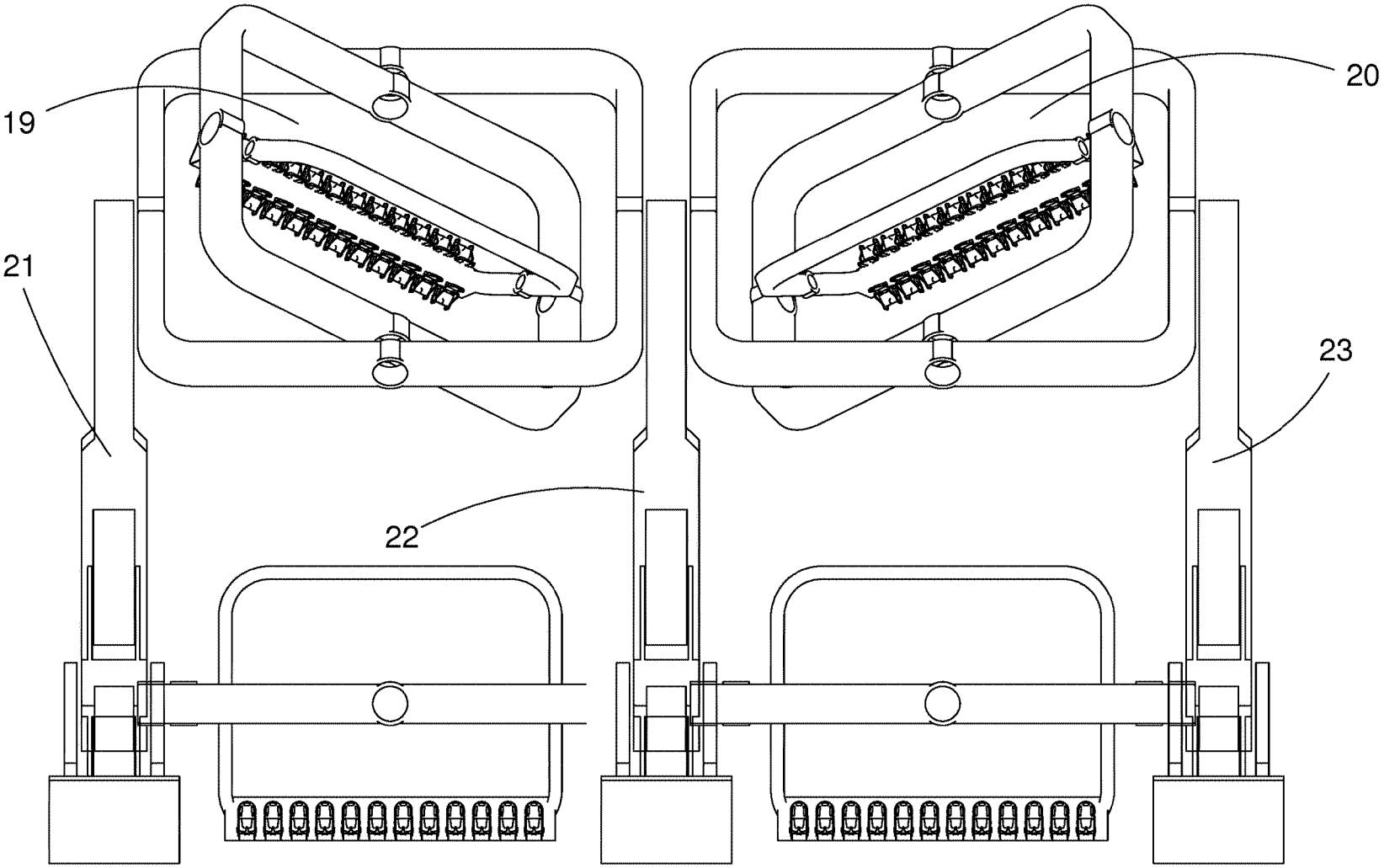
Figure 6:
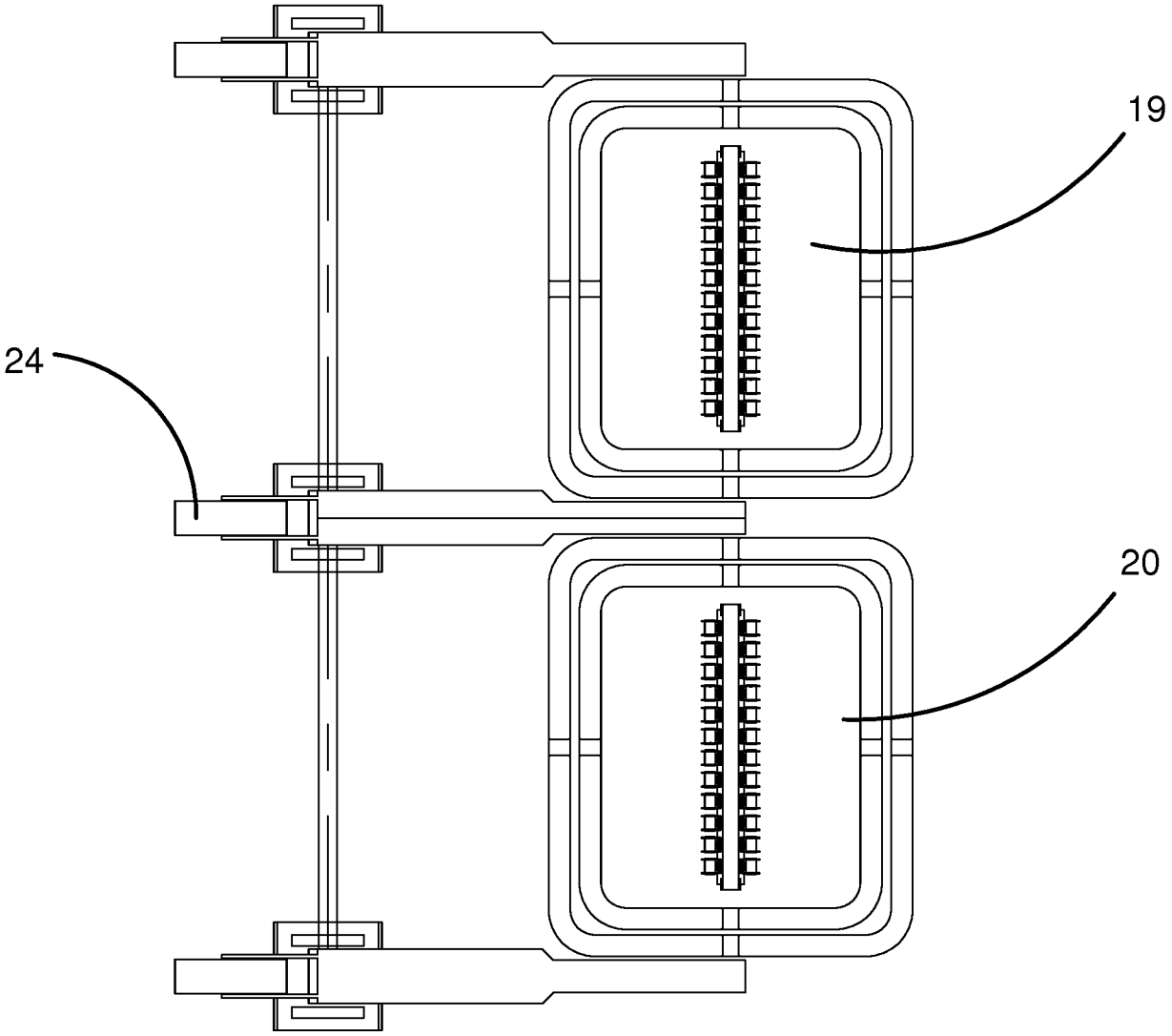

FIGS. 4-6 show a second embodiment of the invention, in which two gondolas 19 and 20 are arranged parallel to each other. The gondolas are suspended via three arms 21, 22, 23. As such, the lifting movement of the gondolas 19 and 20 takes place synchronously. However, the movement sequences of the gondolas 19 and 20 can be either synchronous or different from each other.

FIG. 5 also shows the bottom position of the two gondolas 19 and 20 for loading and unloading.

FIG. 5 shows a side view of the embodiment, which shows that the gondolas are fastened to the support 2 on the end thereof. The opposite end of the support 2 has counterweights 24 in order to establish a weight symmetry on the support 2.

In this embodiment, the loading and unloading of the two parallel gondolas 19 and 20 takes place at the same time; in the first embodiment, the gondolas 3 and 8 are alternately loaded and unloaded.

Figure 7:
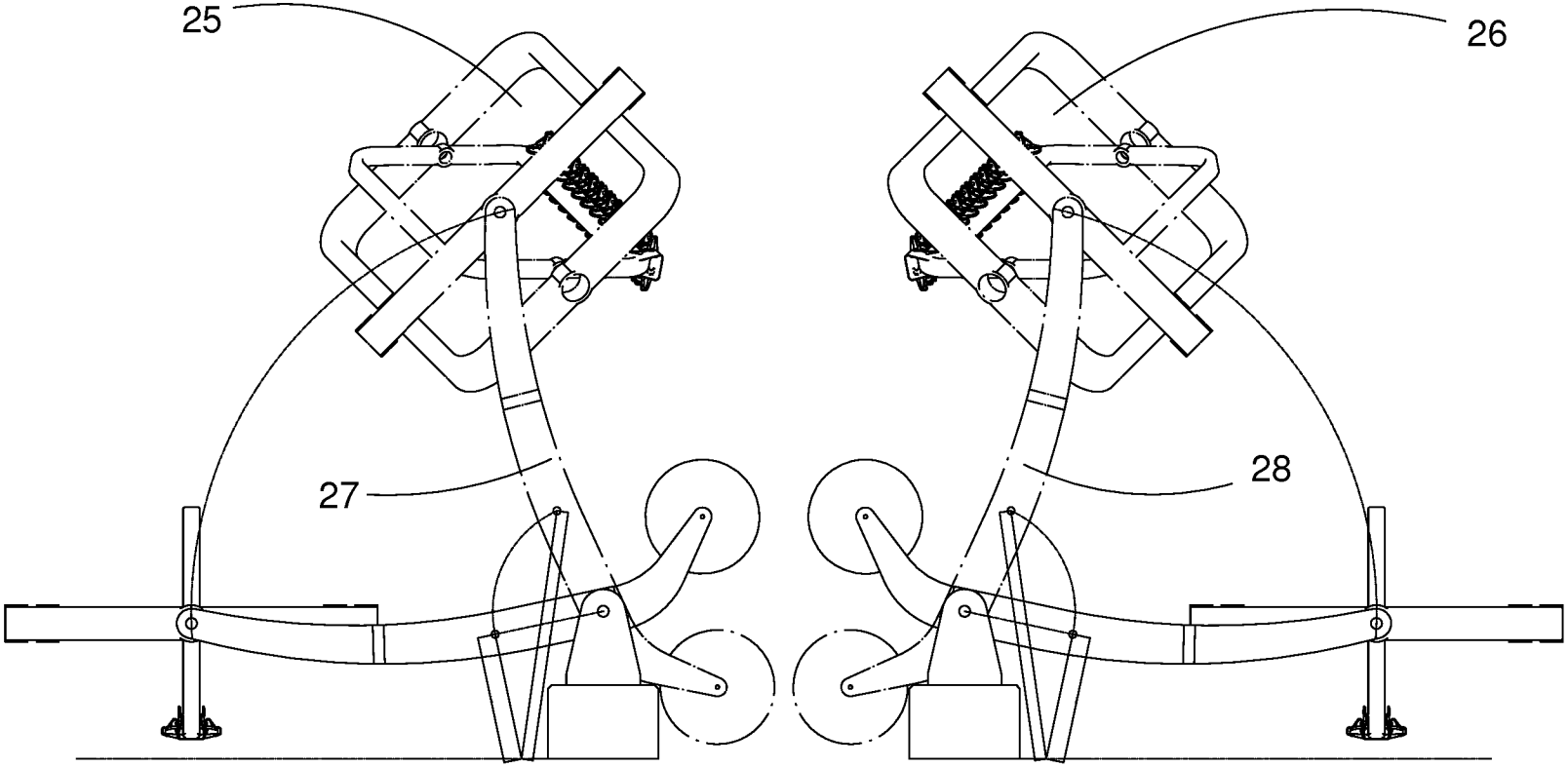
FIGS. 7, 8 show an amusement ride with two oppositely oriented supports.
Figure 8:
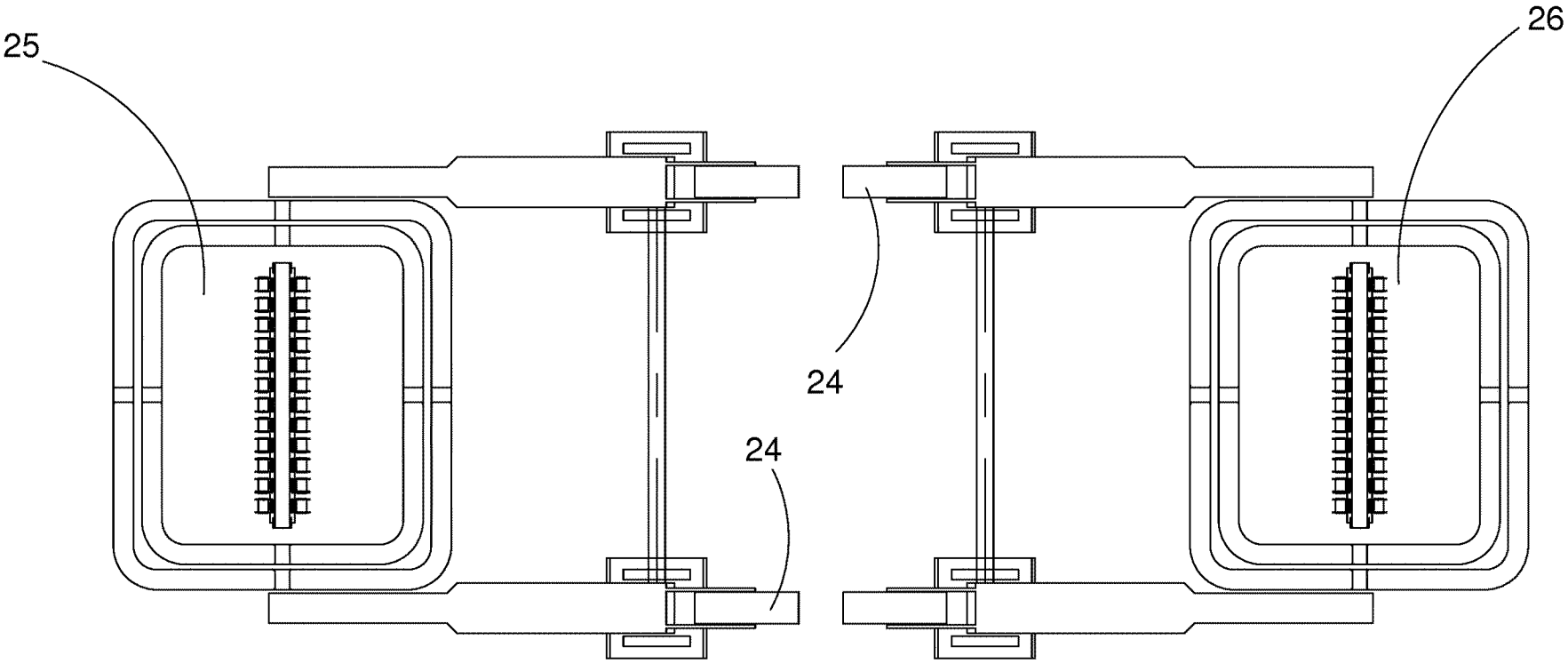

A further embodiment of the invention is shown in FIGS. 7 and 8, in which two gondolas 25 and 26 are fastened to supports 27 and 28. The gondolas 25 and 26 in this embodiment are operated independently of each other; however, synchronous operation is also possible. Also in this embodiment, the supports 27 and 28 each have a gondola at one end, while the other end of the support contains balancing weights.

FIG. 7 shows a side view of the embodiment in which the gondolas 25 and 26 are each shown in two positions. FIG. 8 shows a corresponding view in plan view.

Figure 9:
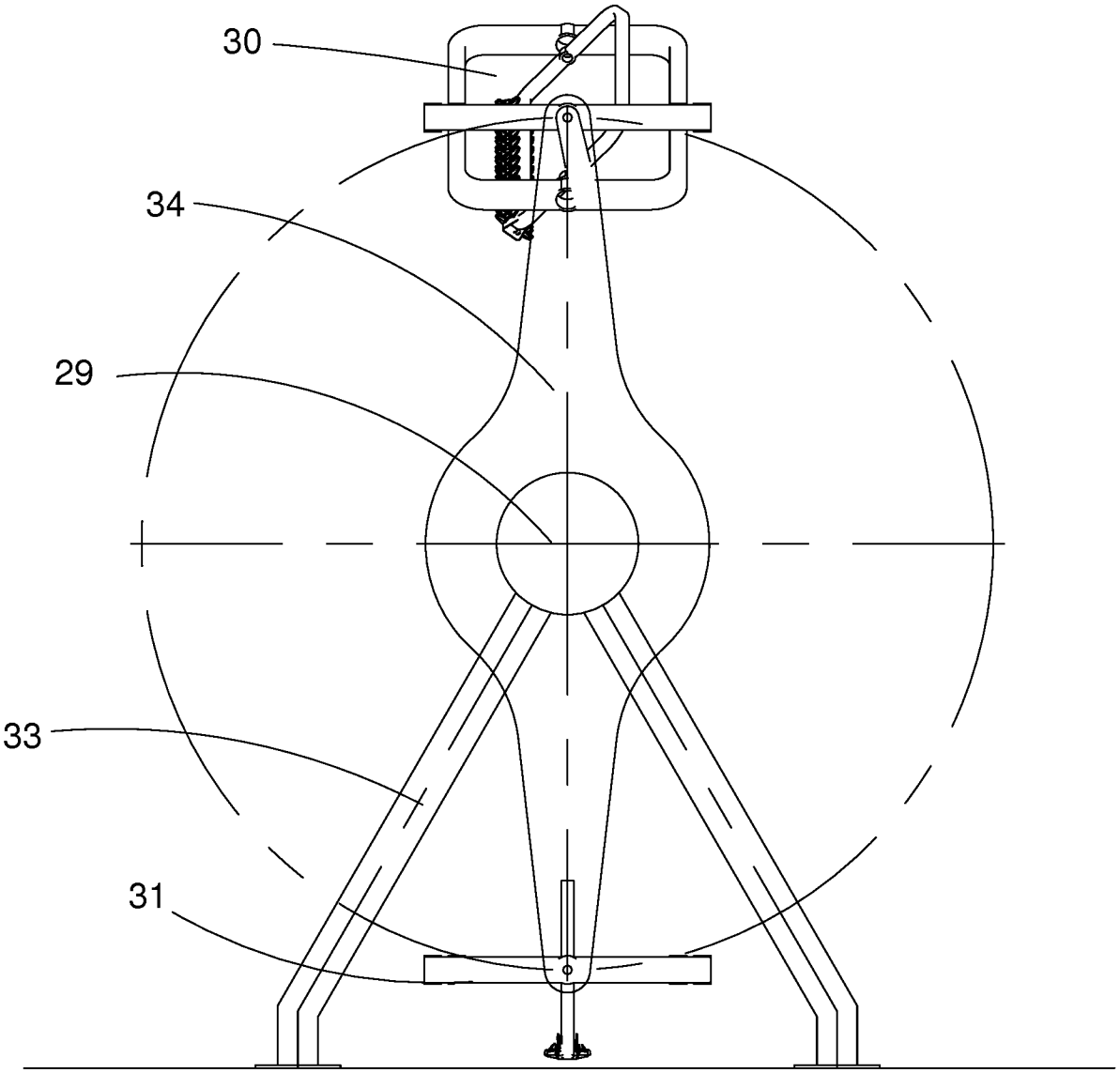
FIGS. 9-11 show arrangements with gondolas on a revolving wheel.
Figure 10:
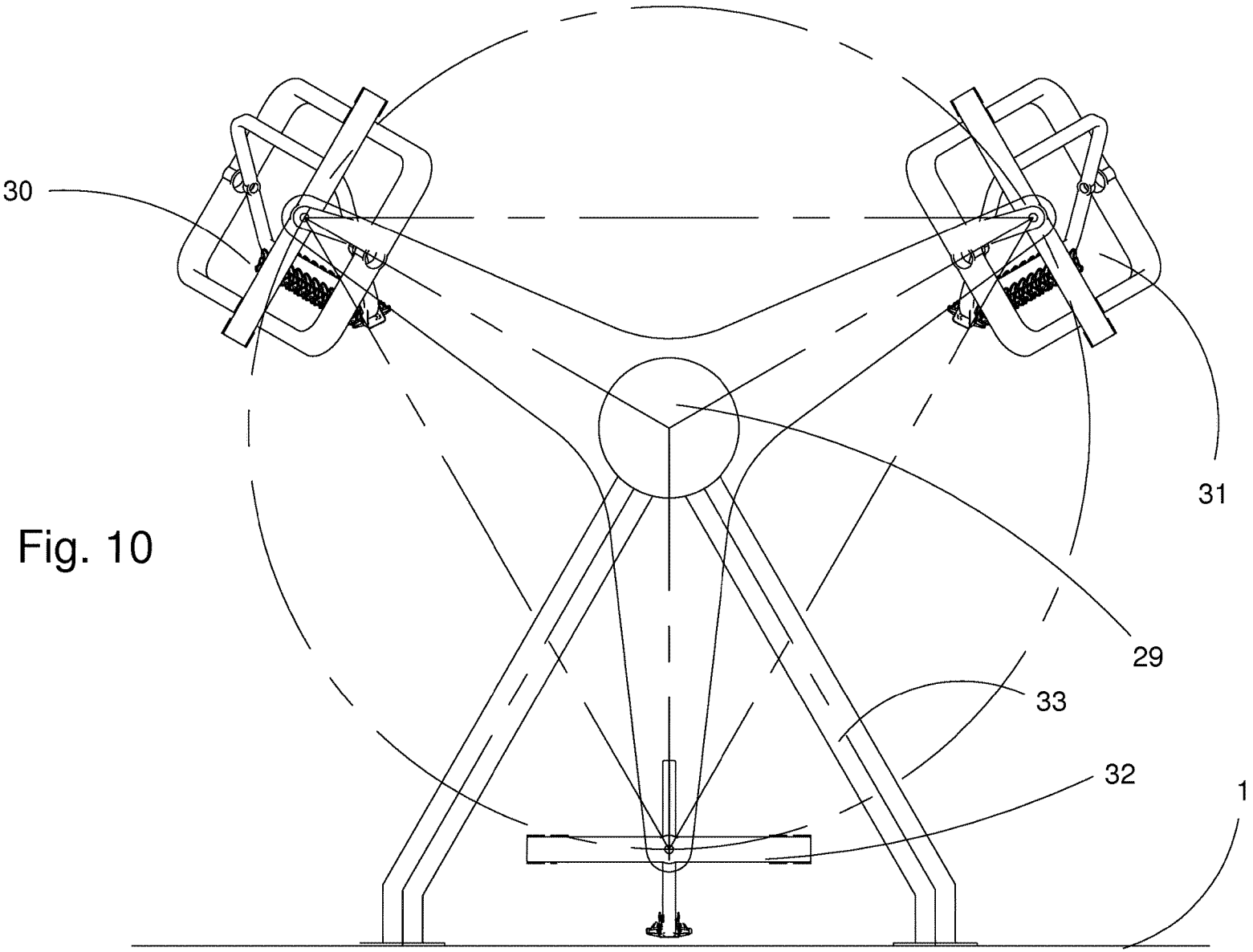
Figure 11:
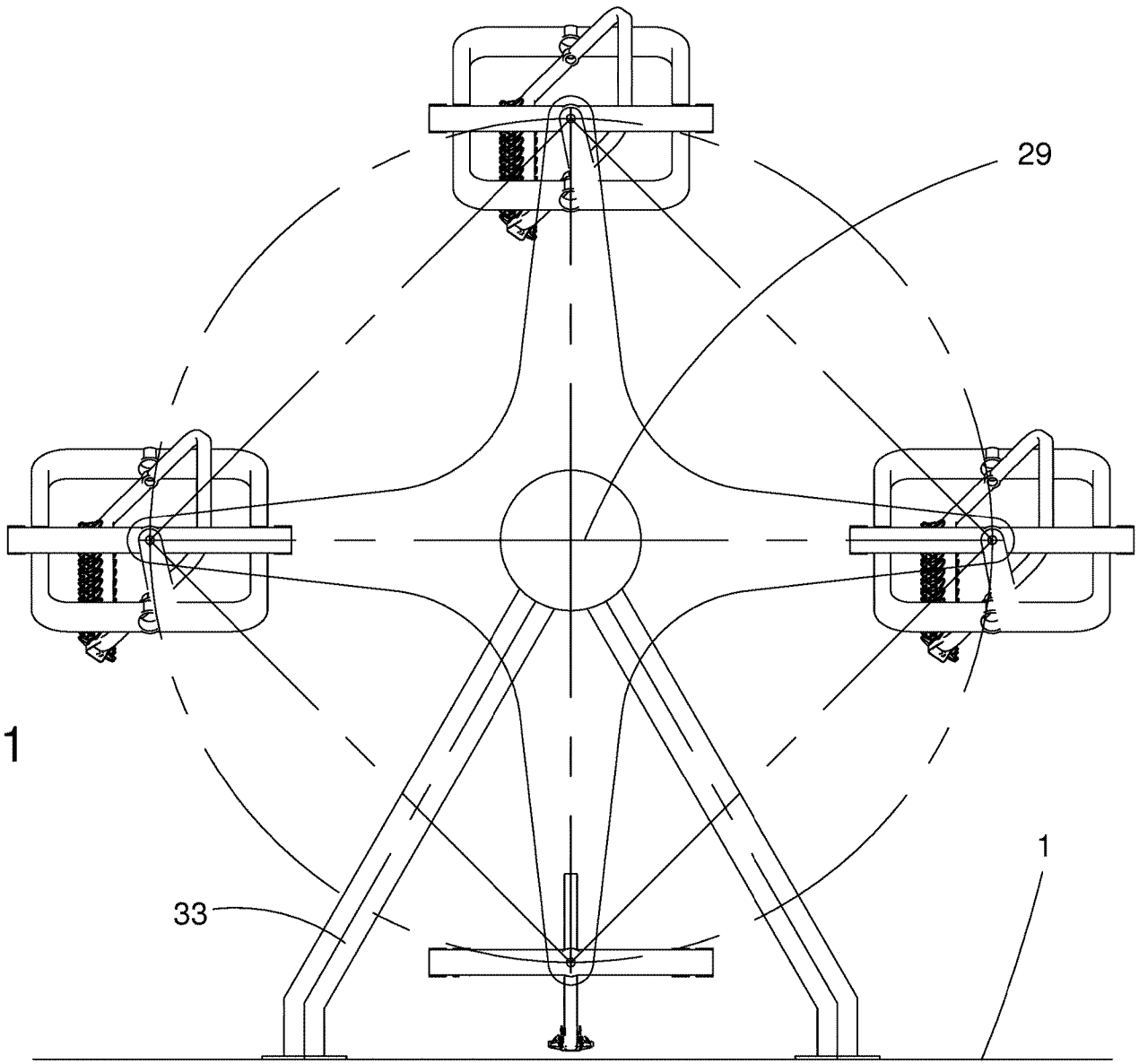

FIGS. 9-11 show a fourth embodiment of the invention, in which a support 34 is fixed to a central axis of rotation 29 and is rotatable about the central axis of rotation 29 in the manner of a Ferris wheel. The gondolas 30 and 31 are located at the peripheral ends of the support 34. The central axis of rotation 29 is located at the top of a support frame 33 which is arranged on the base 1. In this embodiment as well, the gondolas and/or rows of seats are mounted by Cardan suspension.

FIG. 9 shows an embodiment with a support 34 having two gondolas 30 and 31. FIG. 10 shows a three-armed support, with a gondola 30, 31, 32 at each end of the arms of the support, wherein the gondola 32 is in the loading and unloading position. FIG. 11 shows a four-armed support with four gondolas. A greater number of gondolas on an accordingly greater number of arms can be realized accordingly. For a two-armed support, one of the gondolas can also be replaced by a counterweight.

Figure 12:
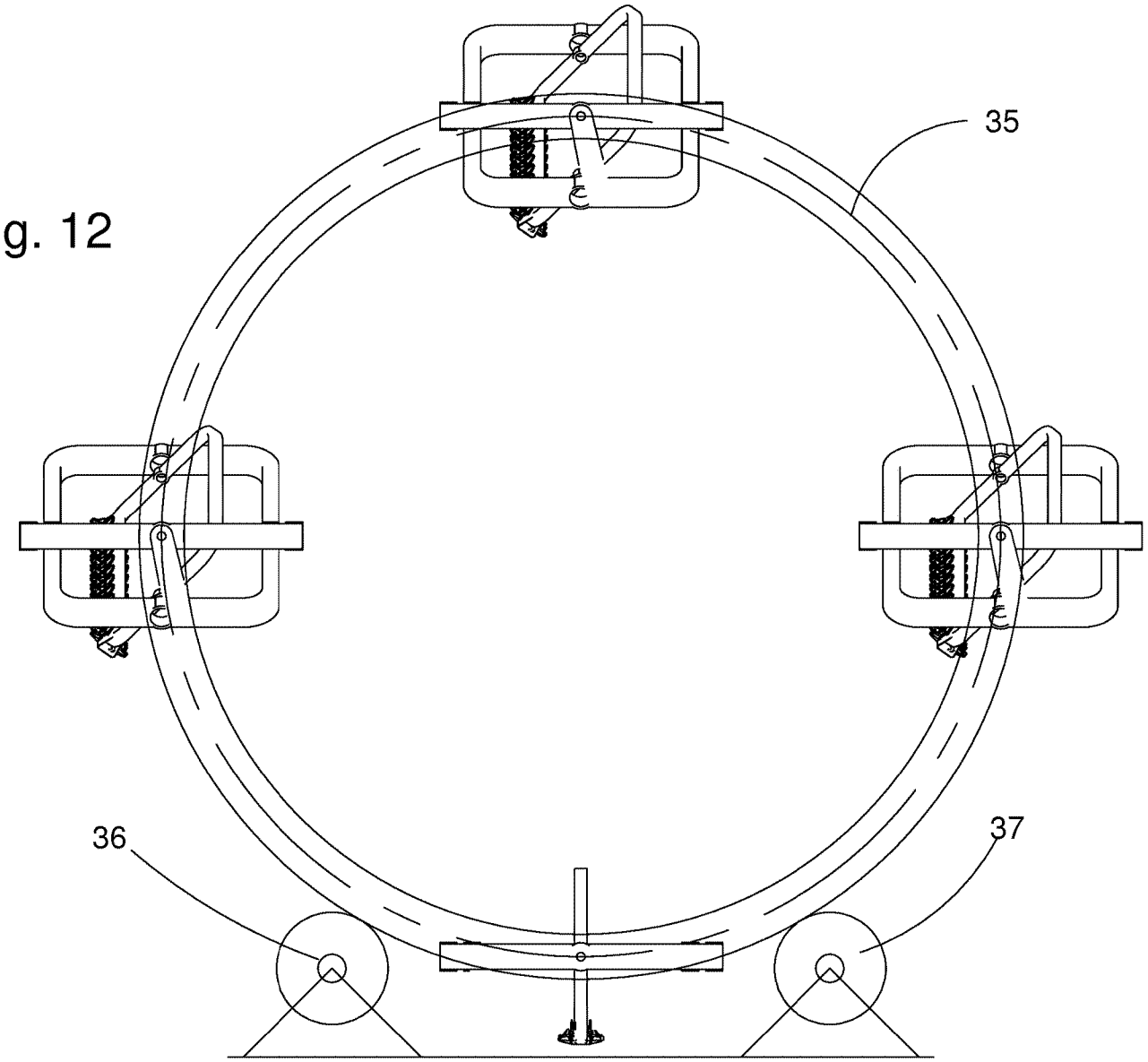
FIGS. 12, 13 show arrangements with a hubless wheel.
Figure 13:
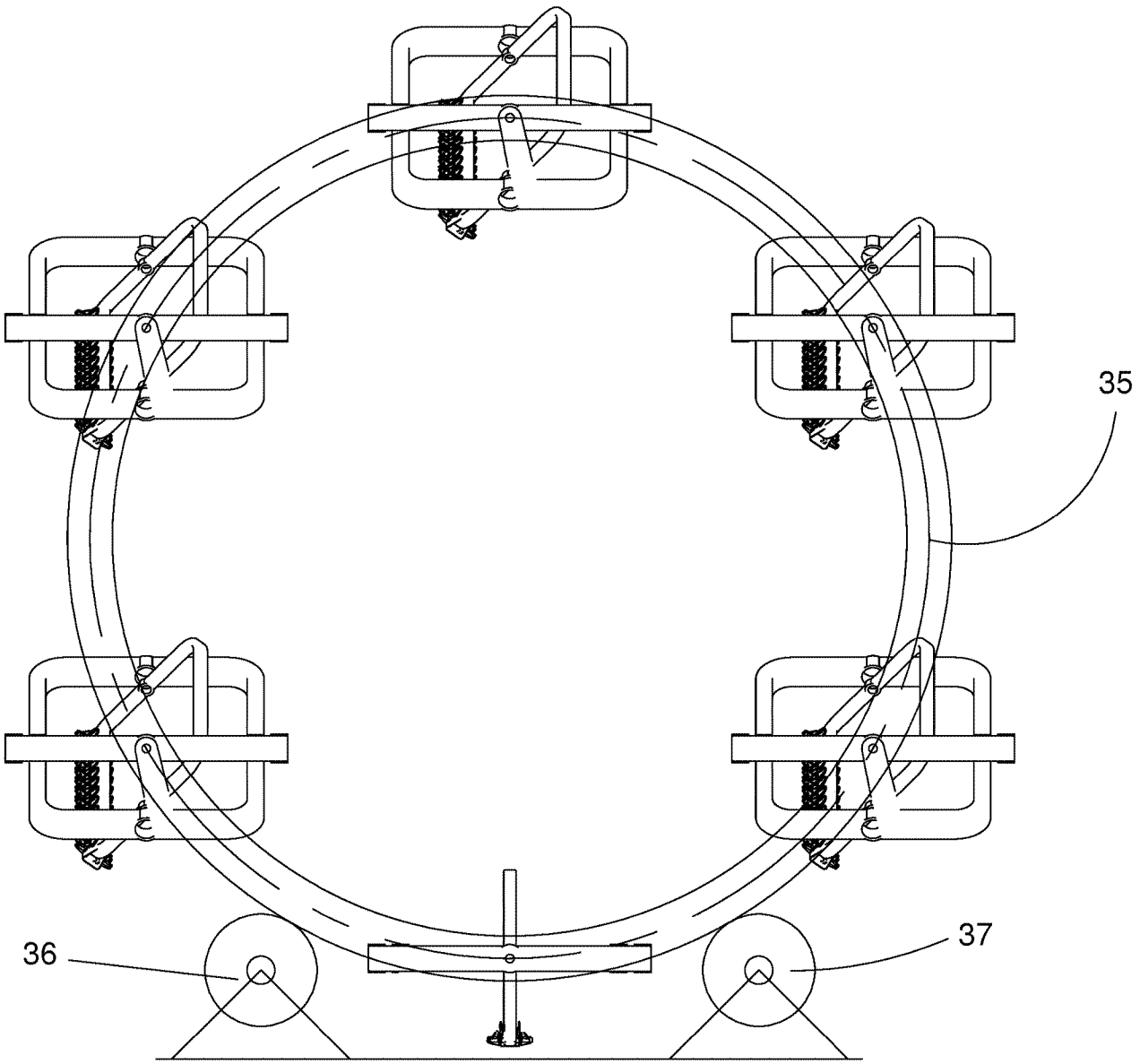
Figure 15:
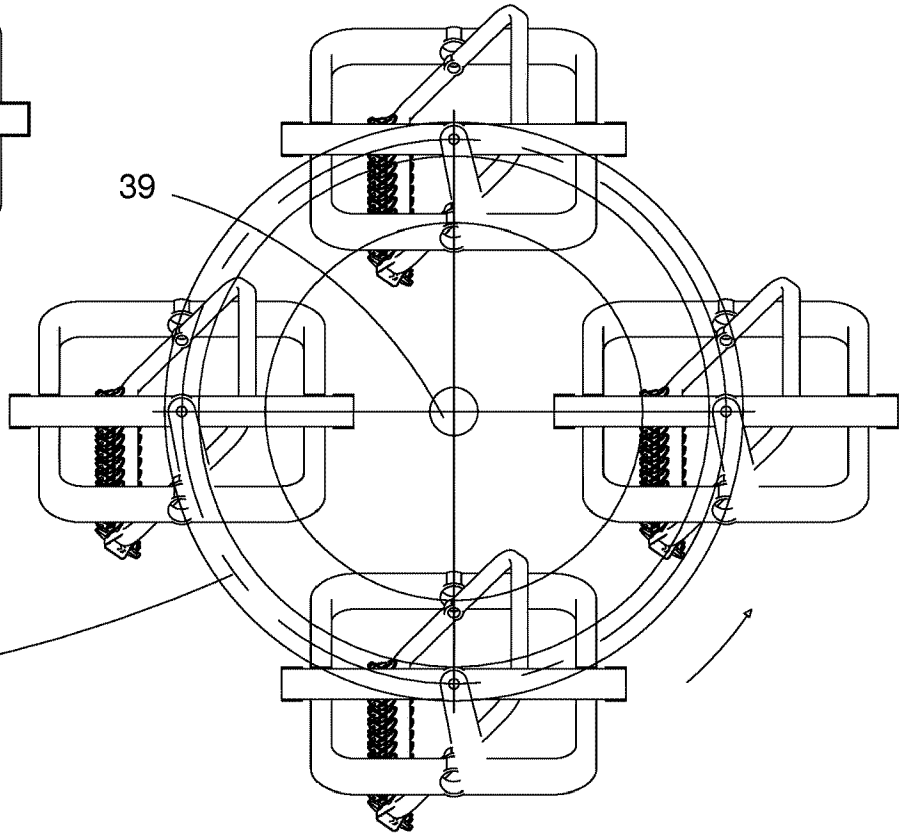
FIGS. 14-17 show arrangements with gondolas that can be moved up and down along a tower.
Figure 14:
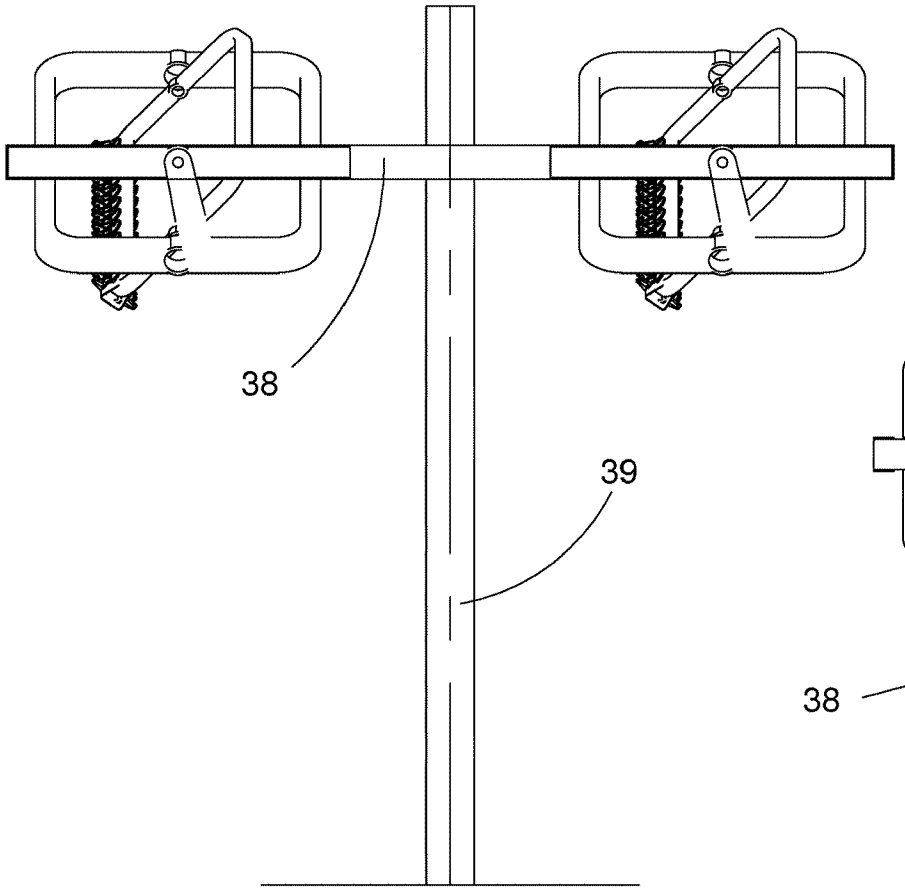
Figure 17:
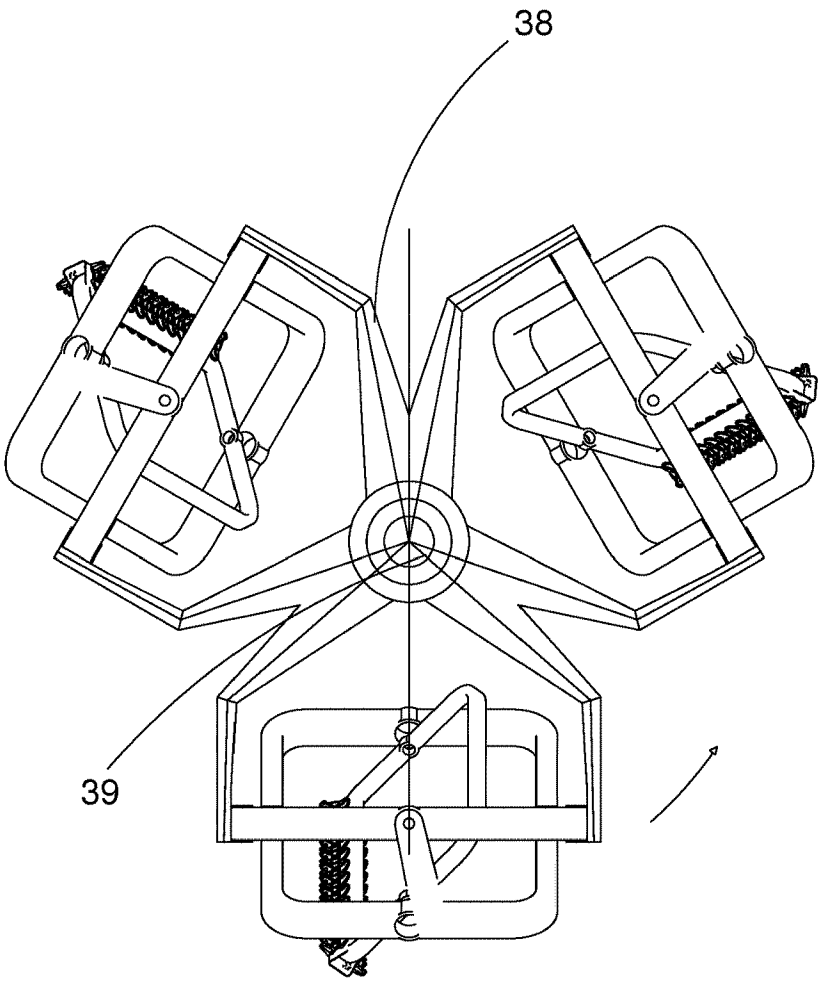
Figure 16:
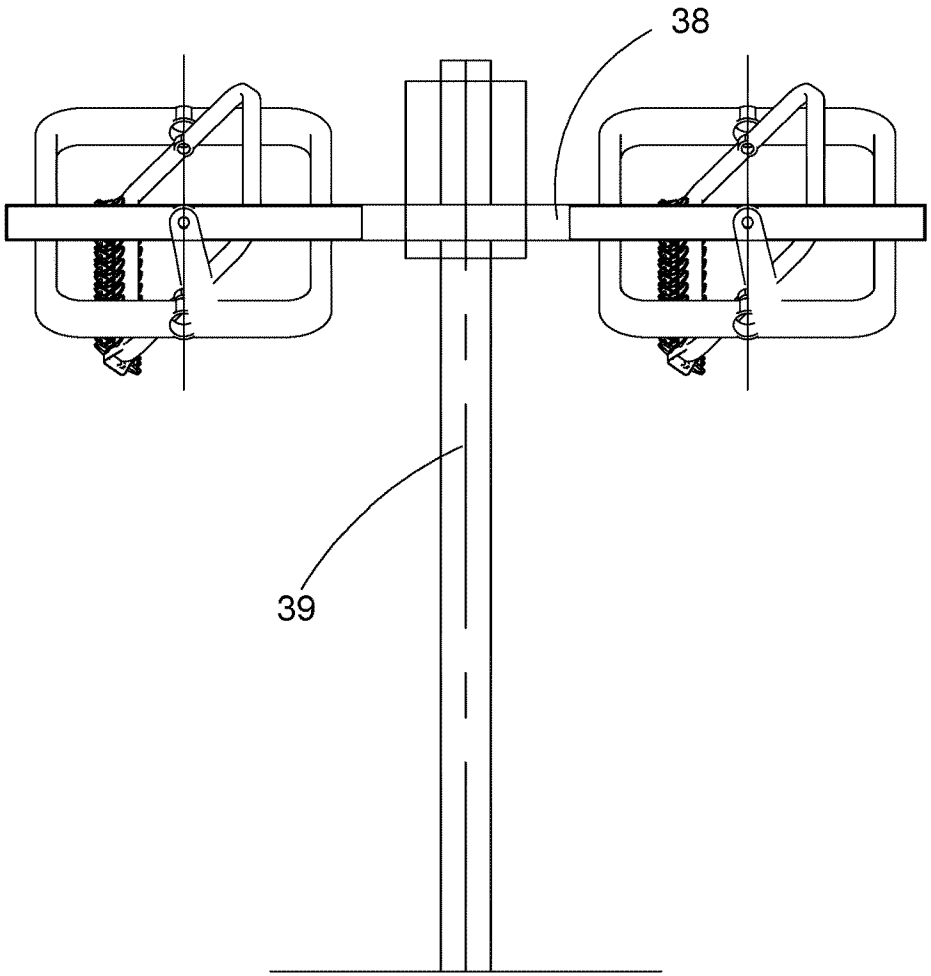

FIGS. 12 and 13 show an embodiment with a plurality of gondolas supported on a carrying wheel 35, which is supported by drive rolls 36 and 37 as an open wheel without a central axis of rotation. In this case as well, the number of gondolas can be kept variable.

FIGS. 14-17 show an arrangement of gondolas fastened to a ring 38 that can be moved up and down vertically along a tower 39. Here as well, the gondolas have a cardanic design, such that each gondola can perform multifunctional movements. The ring 38 may accommodate two, three, four or more gondolas. In addition to a vertical lifting movement, the ring can also be rotated relative to the tower in a horizontal plane.

In the figures, the gondolas are shown as an open frame arrangement. However, the gondolas may also be given a closed design if the outer frame forms a housing in which the intermediate frames and the inner frames are accommodated. The inner frame may also form a housing in which the rows of seats or individual seats can be accommodated in a different arrangement. The housings have doors and are made with or without windows. In this case, the housings can also be provided with projection surfaces on which visual representations are displayed, which can further increase the amusement effect for the passengers.

REFERENCE NUMBERS

| | |
|---|---|
| 1. | base |
| 2. | support |
| 3. | gondola |
| 4. | row of seats |
| 5. | inner frame |
| 6. | intermediate frame |
| 7. | outer frame |
| 8. | gondola |
| 9. | bearing |
| 10. | loading and unloading area |
| 11. | frame |
| 12. | bearing |
| 13. | bearing |
| 14. | bearing |
| 15. | leg |
| 16. | leg |
| 17. | arm |
| 18. | arm |
| 19. | gondola |
| 20. | gondola |
| 21. | arm |
| 22. | arm |
| 23. | arm |
| 24. | inert mass |
| 25. | gondola |
| 26. | gondola |
| 27. | support |
| 28. | support |
| 29. | central axis of rotation |
| 30. | gondola |
| 31. | gondola |
| 32. | gondola |
| 33. | support frame |
| 34. | support |
| 35. | carrying wheel |
| 36. | drive roll, arm |
| 37. | drive roll, arm |
| 38. | ring |
| 39. | tower |

I claim:

1. An amusement ride comprising a base (1) to which is fastened at least one pivotable or rotatable support (2) holding rows of seats (4) mounted in at least one gondola (3, 8), wherein the at least one gondola (3, 8) is movable on the at least one support (2) with respect to the base, at least in a vertical direction, wherein the rows of seats (4) in the at least one gondola (3, 8) are rotatable or pivotable in at least two mutually perpendicular planes, wherein the at least one support (2) is formed by two parallel arms (17, 18) with the at least one gondola (3, 8) arranged between the parallel arms and supported by frames (5, 6, 7) which interlock in a Cardan suspension, such that the rows of seats (4) in the at least one gondola (3, 8) are mounted by Cardan suspension and are movable in three mutually perpendicular planes, wherein the at least one support (2) is an arcuate motor-driven support beam which is curved relative to the base and comprises upwardly swept ends, has said two parallel arms, and is mounted on the base in a central region (9) thereof, and is configured with the at least one gondola (3, 8) on one of the support beam's upwardly swept ends, and wherein the at least one gondola (3, 8) can be loaded and unloaded in its starting position.

2. The amusement ride according to claim 1, wherein two supports (21-23) arranged parallel to one another are fastened to the base by parallel arms, each of which is configured with a gondola (19, 20) of the at least one gondola between the parallel arms on upwardly swept ends, wherein a middle arm (22) is part of both supports.

3. The amusement ride according to claim 2, wherein an inert mass (24) whose weight substantially corresponds to that of a loaded gondola is supported at an opposite end of the support, opposite said one end with the one gondola.

4. The amusement ride according to claim 2, wherein the frames (5, 6, 7) which interlock in a gimbal-like manner are rectangular, oval or circular, wherein an outer frame (7) is rotatably mounted on the arms (21, 23) of the two supports, the rows of seats are mounted on an inner frame (5), and an intermediate frame (6) interconnects the outer frame to the inner frame in a gimbal-like manner.

5. The amusement ride according to claim 1, wherein an inert mass (24) whose weight substantially corresponds to that of a loaded gondola is supported at an opposite end of the support, opposite said one end with the one gondola.

6. The amusement ride according to claim 5, wherein the frames (5, 6, 7) which interlock in a gimbal-like manner are rectangular, oval or circular, wherein an outer frame (7) is rotatably mounted on the arms (17, 18) of the at least one support (2), the rows of seats are mounted on an inner frame (5), and an intermediate frame (6) interconnects the outer frame to the inner frame in a gimbal-like manner.

7. The amusement ride according to claim 1, wherein the frames (5, 6, 7) which interlock in a Cardan suspension are rectangular, oval or circular, wherein an outer frame (7) is rotatably mounted on the parallel arms (17, 18) of the at least one support (2), the rows of seats are mounted on an inner frame (5), and an intermediate frame (6) interconnects the outer frame to the inner frame in a gimbal-like manner.

8. The amusement ride according to claim 7, wherein the inner frame (5) includes two opposed legs (15, 16), with two rows of seats fastened back to back on one leg (15) of the inner frame (5).

9. The amusement ride according to claim 8, wherein the opposed legs (15, 16) are swingable in rotation about an axis of rotation (13) on the inner frame (5).

10. The amusement ride according to claim 7, wherein the rows of seats are fastened to legs (15, 16) of the inner frame (5), the legs being opposite one another on the inner frame (5).

11. The amusement ride according to claim 10, wherein the legs (15, 16) are swingable in rotation about an axis of rotation on the inner frame (5).

12. The amusement ride according to claim 1, wherein two gondolas are positioned on the support, one at each end of the support, so that while one of the two gondolas on the support is loaded and unloaded in its starting position, the other gondola can be operated in a predefined movement program.

* * * * *